US006012734A

United States Patent [19]

Skedeleski

[11] Patent Number: 6,012,734

[45] Date of Patent: Jan. 11, 2000

[54] SNOWBOARD PROTECTIVE TIPS

[75] Inventor: David Skedeleski, Aiea, Hi.

[73] Assignee: Surfco Hawaii, Pearl City, Hi.

[21] Appl. No.: 08/291,596

[22] Filed: Aug. 16, 1994

[51] Int. Cl.[7] ..... A63C 5/04

[52] U.S. Cl. ..... 280/610; 114/219

[58] Field of Search ..... 114/343, 219, 114/39.2; 441/74, 79; 280/608–610, 14.2, 625; 156/212, 239; 427/208.4, 208.8

[56] References Cited

U.S. PATENT DOCUMENTS

| | | | |
|---|---|---|---|
| 3,374,495 | 3/1968 | Joyce | 441/74 |
| 3,481,619 | 12/1969 | Powers | 280/18 |
| 4,321,101 | 3/1982 | Preiser et al. | 114/227 |
| 4,762,080 | 8/1988 | Pearson | 114/219 |
| 4,909,172 | 3/1990 | Hamby | 114/343 |
| 5,174,220 | 12/1992 | Skedeleski et al. | 114/219 |
| 5,299,823 | 4/1994 | Glaser | 280/625 |
| 5,320,378 | 6/1994 | Wiig | 280/610 |

OTHER PUBLICATIONS

Scotch® Joining Systems, A–10 Acrylic Adhesive Family, Product Information, 3M, Sep., 1981.

Scotch™ VHB™ Joining Systems Relative Performance Characteristics Product Information, 3M.

Scotch™ Joining Systems, Adhesive Transfer Tapes Product Information, 3M.

3M Tape Primer 94, Product Information 3M.

*Primary Examiner*—Ed Swinehart

*Attorney, Agent, or Firm*—Nixon & Vanderhye P.C.

[57] ABSTRACT

A protective tip cover is provided for a tip of a snowboard, surfboard, bodyboard, windsurfing board, or other sport board. It includes an integral body of energy absorbing elastomeric plastic having a channel-shaped cross-section interior surface and a rounded exterior surface front portion, and an external top and bottom. Disposed within the channel-shaped interior is a tie coat for tieing an adhesive to the body, and a pressure sensitive adhesive—preferably in the form of a double-faced tape—with a first face engaging the tie coat. The adhesive has properties which will provide secure adhesion of the body to a sport board. A release sheet engages the adhesive and when removed the tip cover can be secured to the sport board nose or tail. The protective tip cover when used with a snowboard is abrasion resistant (e.g. an abrasion resistance according to ASTM D 1044 (H-22 Wheel) of less than 10, typically about 3) and retains its energy absorbing and abrasion resistance properties at temperatures below 0° C. (at which a snowboard would typically be used). The tip cover body has an arcuate plan configuration having an arcuate extent about 150–190° C. from a first to a second end (e.g. about 180°), with a central portion having a ridge facilitating grasping of the tip cover when on a snowboard, and providing additional kick to the snowboard. At least one, and typically three, V-shaped cutouts are formed in the top and bottom only of the body with an angle therebetween of at least about 20°.

17 Claims, 3 Drawing Sheets

SNOWBOARD PROTECTIVE TIPS

BACKGROUND AND SUMMARY OF THE INVENTION

Snowboards have become very popular sport boards in the last 20 years, approaching other sport boards, such as surfboards, in popularity. Snowboards (e.g. see U.S. Pat. Nos. 5,320,378 and 5,299,823) are typically constructed by laminating sheets of material together using adhesives and pressure. Due to the extremely hard use conditions that the boards are typically subjected to, delamination and gouges are common. Snowboard manufacturers have attempted to minimize this problem by adding aluminum plates and/or rivets to the nose and tail portions of the snowboard. While this is helped somewhat in preventing delamination, metal plates and rivets also have added excess weight which appears to adversely affect the performance of the boards, and the expense of these solutions has been significant. Therefore it has long been desirable to provide a solution to the delamination problem that does not adversely affect the board performance characteristics, and is not particularly expensive, and also can be added by the ultimate consumer if a board is purchased that does not have suitable protection.

According to the present invention a protective tip cover is provided for the nose (forward tip), the tail (rear tip), or both of a snowboard. The protective tip cover according to the present invention does not adversely affect the performance characteristics of the board, and in fact it actually enhances the functionality of the board in some respects. A protective tip cover according to the invention can also be replaced if severely damaged or worn and is highly versatile, being utilizable in a wide variety of different snowboards with different nose curvatures and "kick" (the upward bend of the snowboard at the nose and tail).

Adhesively secured plastic protective nose covers for surfboards and other types of water sport boards are known in the art. For example an early configuration of a surfboard nose bumper which minimizes scratching of the surfboard if it should impact sand or rocks is shown in U.S. Pat. No. 3,374,495. Another type of water board protective tip which is designed primarily to protect the user as opposed to the board is shown in U.S. Pat. No. 5,174,220 (the disclosure of which is hereby incorporated by reference herein). However the particular configurations and materials for these water sport board protective tip covers are unusable in snowboards. Snowboards are subjected to much greater abuse, and are typically used at low temperatures, below 0° C., and interact with the snow in a much different manner than a surfboard—or other water sport board—interacts with the water.

According to the present invention a protective tip cover for a snowboard is provided which prevents or greatly minimizes the possibility of delamination of the snowboard tips, but does so without significantly adversely affecting the performance characteristics of the board—in fact enhancing the board characteristics to a certain extent—and in a cost-effective manner.

According to one aspect of the present invention the protective tip cover comprises: An integral body of abrasion resistant, impact energy absorbing elastomeric plastic which remains abrasion resistant and energy absorbing at temperatures below 0° C. at which a snowboard would typically be used. And, the body having a channel shaped cross section interior surface, and a rounded exterior surface front portion, an external top and bottom, and an arcuate plan configuration having an arcuate extent of about 150–190° from a first end thereof to a second end thereof.

The body has a central portion between the first and second ends thereof defining the arcuate extent, and the bottom is substantially flat and the top has—at least at the central portion thereof (and typically extending around most, but not the entire amount, of the arcuate extent thereof)—a ridge facilitating grasping of the tip cover when on a snowboard, and providing additional "kick" to the snowboard. ["Kick" prevents the board from digging into the snow when being ridden.] The body front portion is thickest at the central portion, and substantially gradually tapers in thickness from the central portion to the first and second ends thereof At least one (and preferably three) generally V-shaped cutouts are formed in and substantially completely through the top and bottom of the body (but not the front portion) to facilitate adaptation of the protective tip cover to almost any type of conventional snowboard. Each cutout has first and second edge portions with an angle therebetween of at least about 20°, and when three cutouts are provided the first cutout is at the central portion and side cutouts are each about 40–50° (preferably about 45°) from the first cutout around the arcuate plan configuration, and the first cutout edge portions define a larger angle (e.g. about 30°) therebetween than the side cutout edge portions (e.g. about 20°).

The body is preferably of an elastomeric plastic having an abrasion resistance according to ASTM D 1044 (H-22 Wheel) of less than 10, e.g. about 3. One particularly suitable material for the elastomeric plastic is polytetramethylene glycol ether polyurethane. One commercially available form of this material is Dow Chemical Corporation's "Pellethane 2103-70A" polyurethane elastomer. This has a durometer of about 70–75 on the Shore A scale, good low temperature flexibility, good impact resistance, low compression set, high compression strength, good transparency, and is available in a wide range of colors.

The protective tip cover according to the present invention is adhered to the nose—or to the tail—of a snowboard using any suitable structural adhesive which is typically applied to the board after the board has been cleaned, and the tip cover then placed into contact with the adhesive. The tip cover when in combination with the snowboard does not significantly adversely affect the performance characteristics of the board, but—as indicated earlier—provides additional "kick" in addition to protecting the board from delamination. Also, the very slight increase in weight (40 grams) provided by a protective tip cover according to the present invention which is disposed on the nose of a snowboard (less than the weight of aluminum plates) may reduce the frequency of vibrations at high speeds for certain boards, reducing undesirable "chatter" and even perhaps slightly increasing the performance characteristics.

The bottom of the protective tip is substantially flat (flatter than the top) to provide better glide over snow, ice, and like surface on which the snowboard is typically used. The outer ends and edges are preferably tapered to about 0.015 inches so that the protective tip cover will fit flush with the snowboard surfaces, preventing the edges from getting caught on sharp objects and creating drag. The front portion (that exterior of the board edge) is thicker than the top and bottom because it will be subjected to the greatest amount of impact, and the front portion is thickest at the central portion (gradually tapering in thickness toward the ends as described above) since the central portion will be subjected to the most direct impacts in normal operating circumstances.

According to another aspect of the present invention, an adhesive system has also been developed for use with the protective tip cover to facilitate its application to snowboards. The adhesive system according to the invention is novel for protective tip covers for sport boards in general, however, and is not limited to snowboards. Typically, when tip covers are applied to surfboards, windsurfing boards, and the like—as described in the aforementioned U.S. Pat. No. 3,374,495 and 5,174,220—the adhesive is applied directly to the board, or applied in liquid form inside the protective tip, and then the protective tip cover is placed over the adhesive and pressed down into place until the adhesive dries. However some users are not patient enough to properly apply the adhesive and tip cover in these ways, and would like a more simplified system. The system according to the invention is more simplified, while still providing good adhesion between the protective tip cover and the sport board with which it is utilized (including surfboards, bodyboards, windsurfing boards, or other water sport boards, snowboards, or other sport boards).

According to this, other, aspect of the present invention a protective tip cover for a sport board is provided comprising: An integral body of energy absorbing elastomeric plastic the body having a channel shaped cross section interior surface, and a rounded exterior surface front portion, an external top and bottom. And, disposed within the channel shaped interior, a tie coat for tieing an adhesive to the body; a pressure sensitive adhesive engaging and adhered to the tie coat, and a release sheet engaging the adhesive; the adhesive having properties which will provide secure adhesion of the body to a snowboard, surfboard, bodyboard, windsurfing board, or other sport board.

In a preferred embodiment according to this aspect of the invention, the pressure sensitive adhesive is in the form of a double-face tape with a first face thereof engaging the tie coat and with a second face thereof engaging the release sheet. For example the tie coat may comprise three 3M Primer #94 and the tape may comprise 3M #9473. The tie coat (often alternatively referred to as a "primer") may also be applied to the first adhesive face of the tape to act as a lubricant to allow the tape to slide into the body channel-shaped interior, particularly for water sport board tip covers which are smaller than snowboard tip covers. The tip cover produced according to this aspect of the present invention is extremely simple and easy to use. One merely pulls off the release sheet from the second face of the adhesive tape, then deforms the tip cover as necessary to properly fit on the sport board nose (or tail), and then presses the adhesive into place.

The invention also relates to a method of assembling the protective tip cover described above for a surfboard protective tip cover (or other small tip covers), comprising the steps of applying the tie coat as a lubricant to the first face of the tape, and then inserting the tape into the channel shaped interior of the tip cover.

It is the primary object of the present invention to provide effective prevention of delamination of snowboards, and an effective system for attaching protective tip covers to sport boards. This and other objects of the invention will become clear from an inspection of the detailed description of the invention and from the appended claims.

DETAILED DESCRIPTION OF THE DRAWINGS

Figure 1:
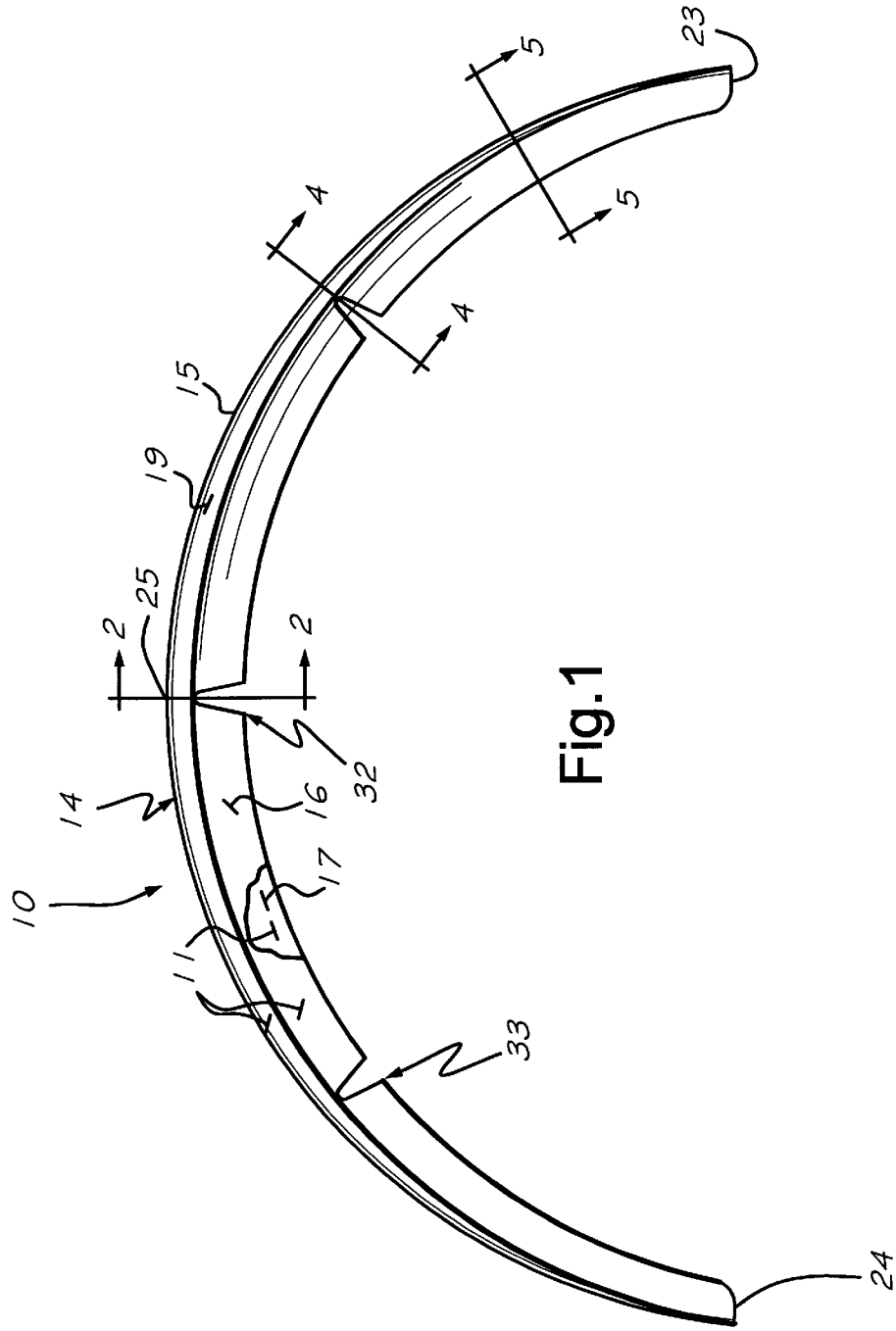
FIG. 1 is an actual scale top plan view of an exemplary embodiment of a protective tip cover for the forward tip of a snowboard, according to the present invention.

FIG. 1 illustrates one embodiment of an exemplary tip cover for protecting the forward tip (nose) or rear tip (tail) of a snowboard, according to the present invention, and is shown generally by reference numeral 10. It includes an integral body 11 of abrasion resistant, impact energy absorbing elastomeric plastic. The body 11 remains abrasion resistant and energy absorbing at temperatures below 0° C., at which a snowboard would typically be used. Preferably the elastomeric plastic according to the present invention has an abrasion resistance according to ASTM D 1044 (H-22 Wheel) of less than 10, preferably about 5 or less, and typically about 3. One particularly suitable material for use according to the present invention comprises polytetramethylene glycol ether polyurethane. This material is available, for example, from Dow Chemical Company and is known as Pellethane® 2103-70A. It has a durometer on the Shore A scale of about 70–75, a specific gravity (ASTM D 792) of about 1.0–1.10, an ultimate elongation percentage (ASTM D 412) of about 730%, a Clash-BEG modulus (° C.) according to ASTM D 1043 of less than −75° C., low compression set, high compression strength, good transparency, and is available in a wide range of colors.

Figure 4:
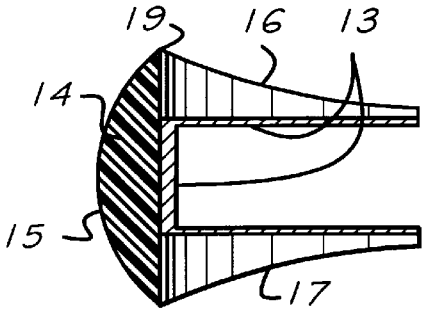
FIGS. 4 and 5 are cross-sectional views taken along lines 4—4 and 5—5 of FIG. 1, respectively.
Figure 5:
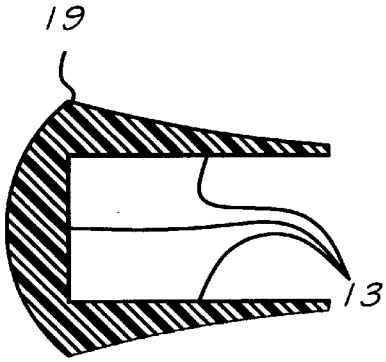

As seen most clearly in FIGS. 1, 2, and 4 through 6, the body 11 has a channel-shaped cross-section interior surface 13 (see FIGS. 4 through 6 in particular), a front portion 14 with a rounded exterior surface 15, an external top 16, and an external bottom 17. The bottom 17 is substantially flat, i.e. slightly flatter than the top 16 and allowing for good glide over snow, ice, or like surfaces. The top 16 has a ridge 19 at least at a central portion of the cover 10, the ridge 19 being the highest substantially at the center (see FIG. 2), and gradually diminishing toward the ends (see FIGS. 4 and 5 compared to FIG. 2, all of which are to the same scale, about four times actual size). The ridge 19 facilitates grasping of the tip cover 10 when on a snowboard 21 (see FIGS. 2 and 7) and provides additional kick to the snowboard 21. As is conventional the nose and tip of the snowboard 21 are upturned.

The tip cover 10 has an arcuate plan configuration as seen in FIG. 1. The arcuate extent of the tip cover 10 is preferably about 180°, as seen in FIG. 1, but it may vary, depending upon the particular snow boards with which it is designed to be used, its particular materials, the number of cutouts therein, etc., so that it extends about 150°–190° from a first end 23 thereof to a second end 24, having a center 25 therebetween and comprising part of the central portion thereof.

Figure 2:
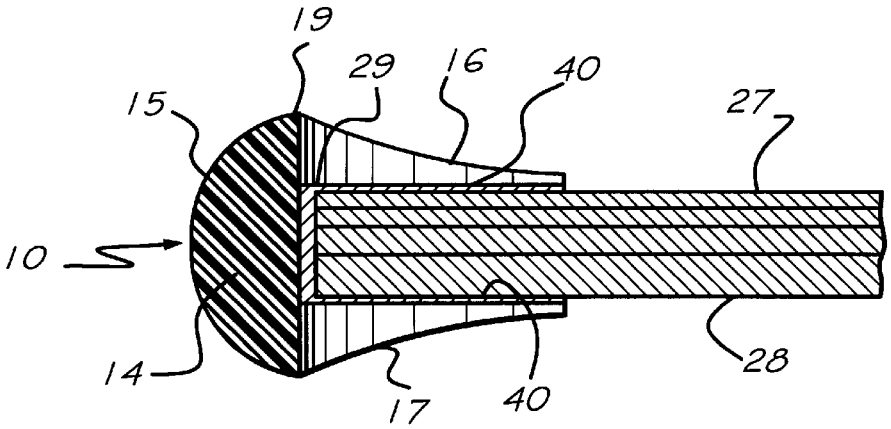
FIG. 2 is a cross-sectional view of the tip cover of FIG. 1 taken along lines 2—2 thereof and shown adhesively secured to the upturned nose of a snowboard.

As also seen by comparing FIGS. 2, 4, and 5, the front portion 14 (the portion applied to the board edge, whether at the nose or tail of the board) is the thickest part and it tapers in thickness from a maximum at the center 25 to minimums at ends 23, 24. The outer ends and edges of the entire cover 10 are preferably tapered to about 0.015 inches so that the cover 10 fits flush with the snowboard 21 top 27, bottom 28 (see FIG. 2), and side 29 (see FIG. 7) surfaces. This prevents the edges of the cover 10 from getting caught on sharp objects and creating drag.

Figure 3:
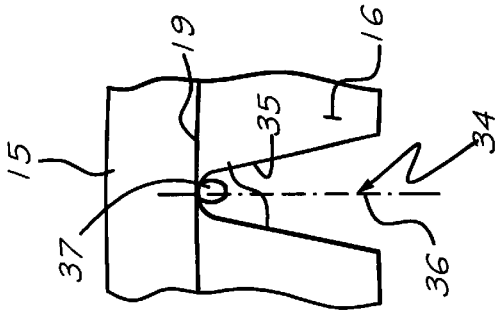
FIG. 3 is an enlarged detail view of one of the side cutouts of the tip cover of FIG. 1.
Figure 6:
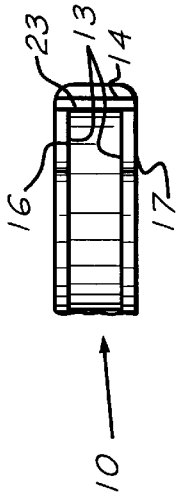
FIG. 6 is a partial end view of one end of the tip cover of FIG. 1.

The cover 10 also has at least one V-shaped cutout therein to facilitate expansion and contraction of the cover 10 so that it can conform to any conventional snowboard. The V-shaped cutouts, such as the central cutout 32 illustrated in FIG. 1, are formed in and extend substantially completely through the top and bottom 16, 17 of the body 11, but not the front portion 14. Each of the cutouts has side edges with an angle therebetween of at least about 20°. For example, in the embodiment illustrated in FIG. 1 the cover 10 has in addition to the central cutout 32 side cutouts 33, 34. The side cutout 34, shown greatly enlarged in FIG. 3, has side edges 35 thereof which make an angle of about 20° with respect to each other (each making an angle of about 10° to an imaginary line 36 substantially perpendicular to the ridge 19). The innermost end of the cutout 34 is rounded, as illustrated at 37 in FIG. 3. In the preferred embodiment illustrated in FIGS. 1 and 3, the cutouts 33, 34 are substantially identical while the cutout 32 has a slightly greater angle between the edges thereof (e.g. about 30°). The cutout 32 is disposed substantially exactly at the center 25, with the cutouts 33, 34 each spaced about 40–50° (e.g. preferably about 45°) from the center 25 (and from the ends 24, 23, respectively).

The cover 10 is adhesively secured to a snowboard 21 in the preferred use thereof. For example as shown schematically in FIG. 2, the cover 10 has a conventional suitable structural adhesive 40 disposed between the top, bottom, and side surfaces 27,29 (see FIG. 7 too) of the snowboard 21, and each of the channel interior surfaces 13.

Figure 7:
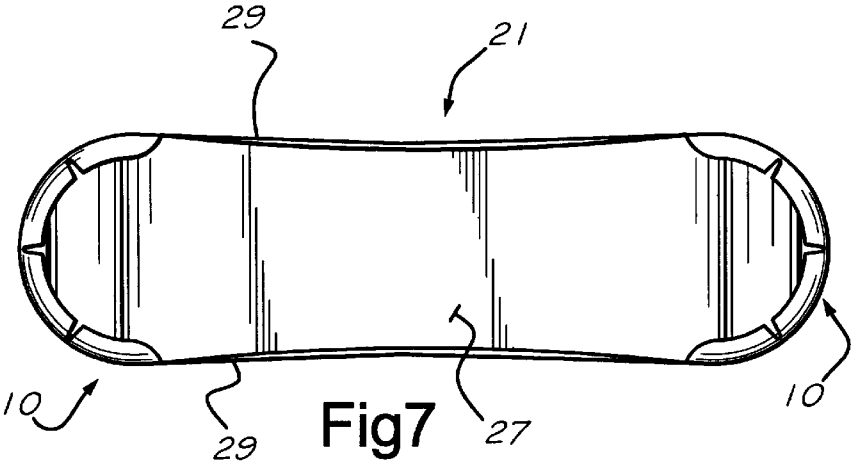
FIG. 7 is a top plan view showing tip covers according to the present invention attached to the nose and tail of a snowboard.

FIG. 7 illustrates a tip cover 10 according to the present invention at both the nose and tail of the a conventional snowboard 21 (shown in FIG. 7 without conventional bindings).

While the conventional adhesive system such as seen in FIG. 2 may be utilized, according to the present invention a novel adhesive system could be utilized instead. This novel adhesive system is shown for use with a snowboard tip cover 10 in FIGS. 8 and 9, and for a surfboard protective tip cover in FIG. 10.

Figure 9:
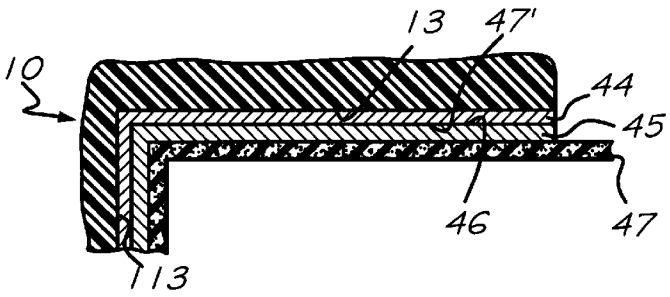
FIG. 9 is a detail cross-sectional view of the tip cover of FIG. 8 with associated adhesive system, with the adhesive system portions thereof exaggerated in size for clarity of illustration.

As seen perhaps most clearly in FIG. 9, in which the various components are exaggerated in size for clarity of illustration, the interior channel-shaped surfaces 13 of the tip cover 10 are coated with the tie coat 44. The tie coat 44 facilitates adhesion of the adhesive utilized to the tip cover 10 material. For example where the tip cover 10 is a polyurethane elastomer described above, the tie coat 44 preferably comprises 3M Primer #94.

Figure 8:
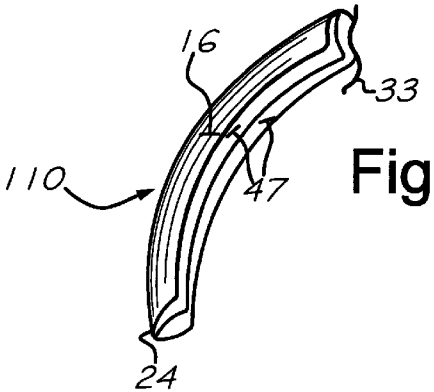
FIG. 8 is an isometric view of the tip cover of FIG. 1 cut through the middle (at a V-shaped cutout therein) showing an adhesive system according to another aspect of the present invention.

Connected to the tie coat 44 is a pressure sensitive adhesive. In the preferred embodiment the pressure sensitive adhesive is in the form of a piece of double faced tape 45 having a first face 46 thereof with pressure sensitive adhesive thereon which engages the tie coat 44, and a second face 47' thereof also with pressure sensitive adhesive. The pressure sensitive adhesive on the second face 47' thereof is covered by a release sheet 47 of conventional release material (e.g. silicone) which can readily be detached from the adhesive on the second face 47'. For the particular embodiment described above, the double faced pressure sensitive adhesive tape 45 may comprise 3M #9473. FIG. 8 shows that the release liner 45 typically overlaps the channel 13, extending outwardly therefrom at essentially all portions.

While the manner of application of the primer, tape, etc. is not part of the present invention, typically the tape 45 (which may already have the release liner 47 associated therewith) may be done by hand using a jig that holds the tape flat and allowing the cover 10 to be pressed onto the tape 45. A rubber print roller, e.g. about two inches wide, may be used to press out any bubbles and wrinkles. The liner 47 remains until the cover 10 is ready for use.

According to the present invention it also may be desirable to facilitate entry of the tape 45 into the channel 13. This may be further facilitated by utilizing the same primer (e.g. 3M #94) to lubricate the tape, as by applying it to the pressure sensitive adhesive on the first face 46, allowing the tape 45 to slide into the channel 13 more easily. After the primer dries the tape adheres to the channel 13 permanently, whether the primer 44 is applied directly to the channel interior surfaces 13, to the tape 45 first face 46 pressure sensitive adhesive, or both.

Figure 10:
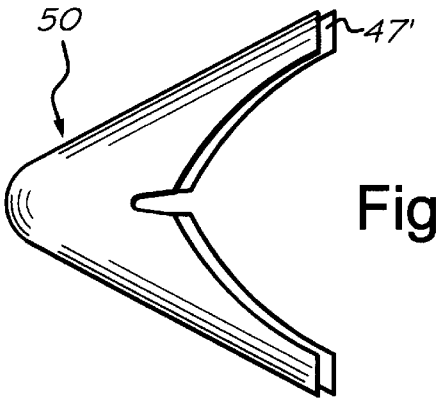
FIG. 10 is a top plan view of an exemplary surfboard tip cover utilized with the adhesive system of FIGS. 8 and 9.

The particular adhesive system described with respect to FIGS. 8 and 9 can also be used for protective tip covers for other sport boards, such as surfboards, windsurfing boards, bodyboards, and the like. FIG. 10 illustrates schematically a tip cover 50 in the form of a conventional NOSEGUARD® tip cover for surfboards available from Surfco, Aiea, Hi. (also shown in U.S. Pat. No. 5,174,220). The tip cover 50 of FIG. 10 has release paper portions 47' extending outwardly therefrom. Since the tip cover 50 will have much smaller and tighter dimensions than the tip cover 10, using the primer as lubricant to cause the tape to slide into position in the interior of the tip cover 50 will be standard procedure, and application will be typically almost completely by hand.

For either of the adhesive systems and tip covers of FIGS. 8 and 9, or 10, respectively, use is very simple. The tip portion of the sport board to which the cover 10, 50 is to be applied is cleaned (e.g. with a solvent supplied by the kit which includes the tip cover), the release paper 47, 47' is removed, the tip cover 10, 50 is distorted and maneuvered until it is disposed at the desired location on the sport board tip to be covered, and then it is pressed into place, the tip cover 10, 50 being firmly pressed down upon by hand over the entire extent thereof so as to cause the pressure sensitive adhesive associated with the tape 45 face 46 to tightly adhere to the surfaces (e.g. 27–29) of the board (e.g. snowboard 21, surfboard, etc.).

It will thus be seen that according to the present invention an advantageous yet cost-effective protective tip cover for preventing delamination of a snowboard has been provided, as well as an adhesive system for application of the tip cover to a snowboard, and also having broader application for use with tip covers associated with other sport boards. While the invention has been herein shown and described in what is presently conceived to be the most practical and preferred embodiment it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A snowboard with protective tip cover, comprising:

a snowboard having an upturned nose and an upturned tail; and a tip cover adhesively adhered to at least one of said snowboard nose and tail so as to prevent delamination of said nose or tail while not adversely affecting the performance characteristics of said snowboard, said tip cover comprising:

an integral body of abrasion resistant, impact energy absorbing elastomeric plastic which remains abrasion resistant and energy absorbing at temperatures below 0° C. at which a snowboard would typically be used; and said body having a channel shaped cross section interior surface, and a rounded exterior surface front portion, an external top and bottom, and an arcuate plan configuration having an arcuate extent of about 150–190° from a first end thereof to a second end thereof.

2. A snowboard with protective tip cover as recited in claim 1 wherein said body has a central portion between said first and second ends thereof; and wherein said front portion is thickest at said central portion of said arcuate plan configuration thereof, and substantially gradually tapers in thickness from said central portion to said first and second ends thereof.

3. A snowboard with protective tip cover as recited in claim 1 further comprising at least one generally V-shaped cutout formed in and substantially completely through said top and bottom of said body, said cutout having first and second edge portions with an angle therebetween of at least about 20°.

4. A snowboard with protective tip cover as recited in claim 3 wherein said body has a central portion between said first and second ends thereof; and wherein three V-shaped cutouts are provided, a first cutout at said central portion, and side cutouts each about 40–50 degrees from said first cutout around said arcuate plan configuration, said first cutout edge portions defining a larger angle therebetween than said side cutout edge portions.

5. A snowboard with protective tip cover as recited in claim 1 wherein said body is of an elastomeric plastic having an abrasion resistance according to ASTM D 1044 (H-22 Wheel) of less than 10.

6. A snowboard with protective tip cover as recited in claim 5 wherein said elastomeric plastic comprises polytetramethylene glycol ether polyurethane.

7. A snowboard with protective tip cover as recited in claim 5 wherein said body front portion is thickest at said central portion of said arcuate plan configuration thereof, and substantially gradually tapers from said central portion to said first and second ends thereof, and further comprising at least one generally V-shaped cutout formed in said top and bottom of said body, said cutout having first and second edge portions with an angle therebetween of at least about 20°.

8. A snowboard with protective tip cover as recited in claim 1 wherein a tip cover is provided on both said snowboard nose and tail, and wherein said elastomeric plastic forming each of said protective tips comprises polytetramethylene glycol ether polyurethane having an abrasion resistance according to ASTM D 1044 (H-22 Wheel) of less than about 5.

9. A snowboard with protective tip as recited in claim 1 wherein a tip cover is provided on both said snowboard nose and tail, and wherein said tip cover has a durometer of about 70–75 A Shore.

10. A method of assembling a protective tip cover and adhesive for a surfboard protective tip, the tip cover comprising an integral body of energy absorbing elastomeric plastic having a channel shaped cross section interior surface and a rounded exterior surface front portion, an external top and bottom, and dimensioned and shaped to cover and protect the nose of a surfboard, and using pressure sensitive adhesive in the form of a double faced tape with a first face and a second face engaging a release sheet, the adhesive of the tape providing secure adhesion of the integral body to a surfboard, the method comprising the steps of sequentially:

applying a tie coat as a lubricant to the first face of the tape;

inserting the tape into the channel shaped interior of the tip cover body so that the tie coat engages the tip cover body and slides into the channel shaped interior, and the release sheet faces outwardly from the body;

allowing the tie coat to dry;

removing the release sheet from the second face of the tape; and applying the adhesive on the second face of the tape to the nose of the surfboard.

11. A snowboard with protective tip cover, comprising:

a snowboard having an upturned nose and an upturned tail;

a tip cover adhesively adhered to at least one of said snowboard nose and tail, said tip cover comprising: an integral body of abrasion resistant, impact energy absorbing elastomeric plastic which remains abrasion resistant and energy absorbing at temperatures below 0° C. at which a snowboard would typically be used; and said body having a channel shaped cross section interior surface, and a rounded exterior surface front portion, an external top and bottom, and an arcuate plan configuration having an arcuate extent of about 150–190° from a first end thereof to a second end thereof;

disposed within said channel shaped interior, a tie coat for tieing an adhesive to said body;

a single piece of pressure sensitive adhesive double-faced tape with a first face thereof engaging and adhered to said tie coat; and a second face of said tape directly adhered to said snowboard.

12. A snowboard with protective tip cover as recited in claim 11 wherein said tie coat comprises 3M primer #94, and wherein said tape is 3M #9473.

13. A snowboard with protective tip cover, comprising:

a snowboard having an upturned nose and an upturned tail; and a tip cover adhesively adhered to at least one of said snowboard nose and tail, said tip cover comprising: an integral body of abrasion resistant, impact energy absorbing elastomeric plastic which remains abrasion resistant and energy absorbing at temperatures below 0° C. at which a snowboard would typically be used; and said body having a channel shaped cross section interior surface, and a rounded exterior surface front portion, an external top and bottom, and an arcuate plan configuration having an arcuate extent of about 150–190° from a first end thereof to a second end thereof; and wherein said body has a central portion between said first and second ends thereof defining said arcuate extent, and wherein said bottom is substantially flat and wherein said top has, at least at said central portion thereof, a ridge facilitating grasping of the tip cover, and providing additional kick to the snowboard.

14. A snowboard with protective tip cover as recited in claim 13 wherein said body front portion is thickest at said central portion of said arcuate plan configuration thereof, and substantially gradually tapers in thickness from said central portion to said first and second ends thereof.

15. A snowboard with protective tip cover as recited in claim 14 further comprising at least one generally V-shaped cutout formed in and substantially completely through said top and bottom of said body, said cutout having first and second edge portions with an angle therebetween of at least about 20°.

16. A snowboard with protective tip cover as recited in claim 15 wherein three V-shaped cutouts are provided, a first cutout at said central portion, and side cutouts each about 40–50 degrees from said first cutout around said arcuate plan configuration, said first cutout edge portions defining a larger angle therebetween than said side cutout edge portions.

17. A snowboard with protective tip cover as recited in claim 16 wherein said body is of an elastomeric plastic having an abrasion resistance according to ASTM D 1044 (H-22 Wheel) of less than 10.

* * * * *